US011976871B2

(12) United States Patent
Duparc et al.

(10) Patent No.: US 11,976,871 B2
(45) Date of Patent: May 7, 2024

(54) METHOD FOR CONTROLLING THE TEMPERATURE AND HUMIDITY OF THE AIR CONTAINED IN AN ENCLOSED REFRIGERATED SPACE

(71) Applicant: DPKL, St. Paul D'Espis (FR)

(72) Inventors: Benoit Duparc, St. Paul D'Espis (FR); Christophe Despierres, Lomme (FR); Kevin Vidot, Toulouse (FR)

(73) Assignee: DPKL, St. Paul d'Espis (FR)

( * ) Notice: Subject to any disclaimer, the term of this patent is extended or adjusted under 35 U.S.C. 154(b) by 64 days.

(21) Appl. No.: 17/736,857

(22) Filed: May 4, 2022

(65) Prior Publication Data

US 2022/0357091 A1 Nov. 10, 2022

(30) Foreign Application Priority Data

May 5, 2021 (FR) ..... 21 04763

(51) Int. Cl.
*F25D 17/06* (2006.01)
*F25D 29/00* (2006.01)
*F25D 21/06* (2006.01)

(52) U.S. Cl.
CPC ..... *F25D 17/062* (2013.01); *F25D 29/00* (2013.01); *F25D 21/06* (2013.01); (Continued)

(58) Field of Classification Search
CPC ..... F28F 13/00; F28F 13/06
See application file for complete search history.

(56) References Cited

U.S. PATENT DOCUMENTS 9,297,571 B1 * 3/2016 Correa ..... F25D 19/00
2023/0021519 A1 * 1/2023 Barker ..... B01D 53/002

FOREIGN PATENT DOCUMENTS

EP 2546084 A1 1/2013
FR 2908873 A1 5/2008
(Continued)

OTHER PUBLICATIONS

Napa Blog: How to Pick a Car Battery That's Right for Your Climate by Erich Reichert, retrieved Aug. 17, 2023 from https://knowhow.napaonline.com/pick-car-battery-thats-right-climate/ (Year: 2021).*

(Continued)

*Primary Examiner* — Jerry-Daryl Fletcher
*Assistant Examiner* — Daniel C Comings
(74) *Attorney, Agent, or Firm* — Craft Chu PLLC; Andrew W. Chu

(57) ABSTRACT

A method for controlling the temperature and humidity level of the air contained in an enclosed refrigerated space includes the step of measuring the temperature of air in the space. The space includes a cooler having a plurality of cold batteries; at least one coolant temperature sensor at the input and at least one coolant temperature sensor at the output of the cooler; at least one fan with an adjustable, reversible direction of ventilation for producing a variable flow of air through the cooler; at least one temperature sensor upstream of the fan; at least one temperature sensor downstream of the cooler; at least one humidity level sensor upstream of the fan; and at least one humidity level sensor downstream of the cooler. The control is affected by reference values given initially for the temperature and humidity level in the enclosed space.

8 Claims, 3 Drawing Sheets

(52) U.S. Cl.
CPC .. *F25D 2317/0682* (2013.01); *F25D 2400/34* (2013.01); *F25D 2600/06* (2013.01); *F25D 2700/12* (2013.01)

(56) References Cited

FOREIGN PATENT DOCUMENTS

| | | | |
|---|---|---|---|
| FR | 3017200 | A1 | 8/2015 |
| FR | 3073936 | A1 | 5/2019 |
| FR | 3091334 | A1 * | 7/2020 |

OTHER PUBLICATIONS

Automaton definition from Merriam-Webster Online Dictionary, retrieved Aug. 17, 2023 from https://www.merriam-webster.com/dictionary/automaton (Year: 2023).*

* cited by examiner

METHOD FOR CONTROLLING THE TEMPERATURE AND HUMIDITY OF THE AIR CONTAINED IN AN ENCLOSED REFRIGERATED SPACE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention falls within the field of storage and conservation of foodstuffs and agri-food products. The invention addresses the question of conservation by refrigeration and control of the atmosphere of the storage and conservation space. It applies preferably to improving the operation of enclosed refrigerated spaces for the storage and conservation of food products. In particular, the invention is aimed controlling air temperature and humidity in this type of enclosed space.

These are usually fresh products and therefore constitute perishable foodstuffs. They are in particular plant products such as fruit and vegetables. However, the invention also applies to the conservation of meat, fish, and dairy products, particularly fermented dairy products such as cheese, and may also be used in the field of curing these types of products. Finally, it is aimed at the conservation of other natural products such as plants and in particular flowers.

2. Description of Related Art Including Information Disclosed Under 37 CFR 1.97 and 37 CFR 1.98

In a known way, these types of products intended for consumption are conserved by storing in a cold room generally at temperatures of between −2 and 4 degrees Celsius (° C.). This conservation in a cold, confined atmosphere limits the drying out of plants and slows down plasmolysis, in other words, hydric stress, which tends first to reduce the weight of the products, then their organoleptic and nutritional qualities and finally degrades their aesthetic appearance. For the consumer, this phenomenon takes the form of a visual and tactile impression of a loss of product "freshness." Moreover, water loss accelerates product senescence, which is the opposite of the object sought of conserving said products for as long as possible in a state of freshness compatible with consumer expectations.

One of the problems that arises in enclosed refrigerated product conservation spaces is that during cooling, the temperature of the product is higher than the saturated vapor temperature of the atmosphere inside the enclosed space. Thus, water vapor pressure at the surface of the product is greater than that prevailing in the atmosphere, even when said atmosphere is practically saturated. This state has an evapotranspiration and drying out effect on the products.

In order to optimize conservation, it is therefore necessary to control the refrigerated atmosphere, in particular its humidity, in order to maintain the turgescence of the products and reduce hygrometric exchanges with the refrigerated atmosphere, thus limiting the loss of water therefrom. However, a balance must be found as the presence of water in liquid form, in particular by deposition in the form of mist or dew on the surface of the products, encourages necroses locally as well as microbial and bacterial growth.

In particular, for any product that has reached the wilting stage, humidification will encourage and accelerate rotting. To overcome this problem, it is customary to spray water particles under pressure, formed in particular of microdroplets, which may or may not be combined with water vapor, to form a dry mist or fog which limits the deposition of water on the surface of the products. However, such a solution requires the installation of a hydraulic plant which is complex to set up and maintain, in particular making control of the hardness of the water necessary in order to limit deposits of limescale in the circuit, and also to treat said water against microbial and bacterial proliferations. These operations are costly and often require the addition of treatment agents such as chlorine which are detrimental to product conservation and consumption.

In addition, injecting water may encourage and increase the formation of frost or even ice within enclosed spaces that are sometimes refrigerated to temperatures of less than 0° C. It is therefore necessary to defrost the installation more often, an operation which is also costly.

In fact, whatever the system envisaged, when handling products in order to store or remove them from the enclosed space, controlling the temperature and atmosphere is particularly difficult. Generally, and particularly when storing new products that have come from an ambient atmosphere, opening the enclosed space leads to air being replaced and energy being input in the form of heat. In response to this heat input, existing systems commonly implement a sudden operational change, particularly in relation to refrigeration, in order to return to the required reference temperature. A 2% to 10% loss of product mass is noted in these cases. As well as the undesirable economic aspect and wasted energy, this loss is inevitably accompanied by a reduction in product quality, as explained earlier.

To optimize the conservation and preservation of the quality of the foodstuffs stored in an enclosed refrigerated space, maintaining the humidity level of the air in said enclosed space as constant as possible, naturally and without adding water, has already been proposed. As well as managing the temperature, the aim is consequently to keep the humidity level as constant as possible (for example between 90% et 99%), not only over a period of a few days, but throughout a refrigerated conservation period that may typically last between 2 and 12 months.

Such a method for regulating the temperature and humidity of air inside an enclosed refrigerated space is in fact based on a reference temperature and a reference measured humidity determined by a user. The variation in temperature and humidity is achieved by circulating a coolant from a conventional central refrigeration unit in a refrigeration loop. Regulation is controlled by an automaton that constantly compares the measured temperature and humidity of the ambient air with said reference temperature and humidity values.

In fact, in the main and in a very simplified way, when the temperature of the interior air is greater than the reference temperature, the automaton actuates a cold production method and if the humidity of the air is greater than the reference value, said automaton reduces the output of an internal fan.

BRIEF SUMMARY OF THE INVENTION

The present invention aims to further improve the regulation of a cold room in order to keep the products stored there fresh, by fine-tuning and optimizing the management of different parameters inside and outside the enclosed refrigerated space. The method which is the object of the invention allows the temperature and humidity level of the air contained in an enclosed refrigerated space to be controlled and comprises:

- a cooler comprising a plurality of cold batteries provided with means for selecting the number of cold batteries in service in order to vary the cooling capacity, said cooler being supplied with a coolant of variable speed and temperature;
- at least one coolant temperature sensor at the input and at least one coolant temperature sensor at the output of the cooler;
- at least one fan with an adjustable, reversible ventilation direction for producing a variable flow of air through the cooler;
- at least one temperature sensor upstream of the fan;
- at least one temperature sensor downstream of the cooler;
- at least one humidity level sensor upstream of the fan;
- at least one humidity level sensor downstream of the cooler;
- said control being effected from reference values given initially for the temperature and humidity level in the enclosed space.

According to the invention, the method is such that it comprises the following operating loops:

A. Measuring the temperature of the air in the enclosed space;

B. If the measured temperature of the air in the enclosed space is higher than the reference temperature;

1. if said temperature is higher than a predetermined threshold temperature:
   cooling by increasing the flow of air, cooling and increasing the speed of the coolant, establishing a maximal cooling capacity by selecting all the cold batteries;
2. if said temperature is below said predetermined threshold temperature:
   measuring the humidity level, comparing it with the reference humidity value and modifying the humidity level, if it is not equal to the reference value, by varying the flow of air, the temperature and the speed of the coolant, and the cooling capacity;

C. If the measured temperature of the air in the enclosed space is less than the reference temperature
   measuring the humidity level, comparing it with the reference humidity level and modifying the humidity level if it is not equal to the reference value, by varying the flow of air and the direction of ventilation, the temperature and speed of the coolant and the cooling capacity.

The regulation method according to the invention therefore allows very precise control, offering optimal regulation of humidity which allows high relative humidity levels of up to 99% to be achieved in a stable way and without a humidifier. Specific hygrometry management is produced by means of specific sizing of the cooler, in particular of the ratio of the heat exchange surface of the cooler to the internal volume of the enclosed refrigerated space which may vary, depending on the respiratory coefficient of the foodstuffs stored, from 1.0 $m^2/m^3$ to 1.5 $m^2/m^3$, and in particular on the pitch of the fins positioned on the batteries of the cooler, which may range from 2 mm to 5 mm. This very precise fin pitch allows better retention of the water droplets on the surface of said fins and, coupled with the large exchange surface of the cooler, allows easy enrichment of the ambient air with water vapor. The cold batteries coupled to the control system allow extremely small relative temperature variations to be achieved, making it possible to dispense with the defrosting cycle at conservation temperatures above 0.5° C. The resulting energy savings are increased in the knowledge in particular that there is no longer any loss of performance at the exchange surfaces of the cooler as the air no longer encounters resistance linked to the formation of frost on the cold batteries, the consequence of the appearance of frost being a fall in the heat transfer coefficient. Heat exchanges are considerably improved. In hardware terms, refrigeration conditions are controlled in reality by an automaton which centralizes the processing of all the parameters and is positioned in the vicinity of the enclosed space. Thus, in particular the cooling capacity of the cooler is expressed by the number of cold batteries in service, said cooling capacity being varied by modifying this number.

The reduction in temperature variations and the absence of defrosting cycles (which lead to a rise in temperature often of 3° C. to 4° C.) coupled with high humidity also lead to a reduction in the hydric stresses suffered by the foodstuffs. This is because these hydric stresses correspond to a water vapor-pressure deficit (VPD) between the fruit and the surrounding air. VPD is defined as the relationship between the often saturation internal water vapor pressure of the foodstuff and the water vapor pressure of the surrounding air. The higher the water content of the surrounding air, the lower the VDP and the lower the hydric stress. Moreover, the saturation water vapor pressure increases with the temperature. Therefore, a reduction in temperature rises reduces VDP and thus hydric stresses. There would therefore be less outward movement of free water inside the cells of the plant foodstuffs, reducing the loss of turgescence and the stresses linked to cell plasmolysis. However, these plasmolysis phenomena lead to a concentration of intracellular solutes which encourages oxidation reactions inside the fruit and vegetables. These phenomena may lead to a reduction in the firmness of the foodstuffs, for example, linked to both the loss of water and the oxidizing enzymatic degradation of the cell wall which reduce the tissue structure of the foodstuff. These oxidation reactions are often harmful to the fruit and vegetables, resulting in the appearance of unsightly physiological conditions (browning, wilting, etc.) or physical-chemical conditions (loss of rigidity, loss of water, loss of weight, etc.). Thus, the method according to the invention allows the conservation problems of these perishable foodstuffs to be reduced in part and their organoleptic and physical-chemical properties to be maintained as much as possible.

This method in fact allows almost ideal conditions for the conservation of perishable foodstuffs to be implemented. High, precise and stable humidity allows the weight loss linked to water loss from the foodstuffs to be very substantially reduced. This high humidity is achieved naturally, that is in particular without the addition of a humidifier. It results from managing the water vapor contained in the ambient air and the respiration vapor from the conserved foods. The enclosed refrigerated space therefore has no fog and no liquid water deposited on the stored products. Indeed, the presence of liquid water on the surface of the products is often the source of fungal growth harmful to the conservation of the products, consequently leading to significant economic losses.

Of course, depending on the humidity conditions recorded, the parameters of the enclosed space must be managed differently in accordance with the temperature measurements. Thus, if the following cumulative temperature and humidity conditions are met: B. if the air temperature is higher than the reference temperature and 2. if said temperature is less than said predetermined threshold temperature, and if the humidity level is less than the reference humidity level, a processing cycle for the following parameters is set in motion:

- increasing the flow of air in the enclosed space;
- establishing maximal cooling capacity by selecting all the cold batteries;
- increasing the temperature of the coolant;
- reducing the circulation speed of the coolant.

The concomitant increase in the flow of air and the temperature of the coolant leads to an increase in the humidity level of the air. This is because the water initially trapped on the exchange surface of the cooler is released into the air by evaporation. Moreover, given that the flow of air is greater, the water present in the ambient air is conserved because condensation on the exchange surface of the cooler is reduced.

However, if the cumulative temperature and humidity conditions are as follows: B. the air temperature is greater than the reference temperature, 2. said temperature is less than said predetermined threshold temperature, and if the humidity level is greater than the reference humidity level, a processing cycle for the following parameters is set in motion:

- reducing the flow of air in the enclosed space;
- bringing a third of the cold batteries into service;
- reducing the temperature of the coolant;
- increasing the circulation speed of the coolant.

In substance, as the ventilation and the temperature of the coolant reduce, the water present in the (moist) air is again trapped on the exchange surface of the cooler. This is because as moist air passes over a colder surface, the temperature of which is less than that of the dew point, said air is cooled and loses some of its water vapor. As a result, the humidity level in the enclosed space falls.

Finally, if said cumulative temperature and humidity conditions are: B. the temperature of the air is greater than the reference temperature and 2. said temperature is less than said predetermined threshold temperature, and if the humidity level is equal to the humidity reference value, a processing cycle for the following parameters is set in motion:

- stabilizing the flow of air in the enclosed space;
- stabilizing the number of cold batteries in service;
- stabilizing the temperature of the coolant;
- stabilizing the circulation speed of the coolant.

According to one possibility, the threshold temperature—which by its nature differs substantially from the reference temperature—is at least equal to the reference temperature plus 3° C. This is a temperature that clearly shows a deviation from optimal or at least correct operation which should be rectified as quickly as possible.

After having envisaged the methods for controlling the refrigeration conditions in the enclosed space if the temperature of the air there is greater than the reference temperature, the following shows how said conditions are managed in the case of temperatures that are less than said reference temperature.

In this case, according to a first possibility, if the new cumulative temperature and humidity conditions are: C. the temperature of the air is less than or equal to the reference temperature and the humidity level is less than the humidity reference value, a processing cycle for the following parameters is set in motion:

- increasing the flow of air in the enclosed space;
- establishing a maximal cooling capacity by selecting all the cold batteries;
- measuring the temperature of the coolant:
  - if the temperature of the coolant is less than the temperature of the air in the enclosed space, increasing the circulation speed of the coolant;
  - if the temperature of the coolant is higher than or equal to the temperature of the air in the enclosed space, stopping the circulation of the coolant.

In practice, the reference value for the air flow of the fan or fans in the enclosed refrigerated space which are provided in order to produce a flow of air through the cooler is adjusted upwards in order to enrich the air by evaporation of the water trapped on the exchange surface of the cooler.

Next, according to a second possibility, if the cumulative temperature and humidity conditions are: C. the temperature of the air is less than or equal to the reference temperature and the humidity level is equal to the reference humidity level, a processing cycle for the following parameters is set in motion:

- reducing the flow of air in the enclosed space to a predetermined value and/or reversing the direction of ventilation;
- establishing maximal cooling capacity by selecting all the cold batteries;
- maintaining the temperature of the coolant:
- stopping the circulation of the coolant.

The purpose of reversing the ventilation direction is to accelerate detection of the rise in the air temperature which originates from the respiration heat of the products, as will be seen in more detail below. It should be noted that without this reversal the refrigeration installation would take longer to capture the rise in temperature and moreover the time taken for the air to pass through the entire mass of stored products could warm said products in passing. It should be noted that during this phase of reversing the direction of ventilation, the temperature adjustment probe is positioned downstream of the cooler.

Finally, according to a third possibility, relating to cumulative temperature and humidity conditions which are: C. the temperature of the air is less than or equal to the reference temperature and the humidity level is greater than or equal to the reference humidity value, a processing cycle for the following parameters is set in motion:

reducing the flow of air in the enclosed space to a predetermined value and/or reversing the direction of ventilation;

establishing maximal cooling capacity by selecting all the cold batteries;

reducing the temperature of the coolant to a predetermined value;

increasing the circulation speed of the coolant to a predetermined higher value.

In this case, as in the previous one, the automaton reduces the reference ventilation value to the minimum in order to lessen the release of heat from the electric motors of the fans. It should be noted that once the refrigeration cycle is restarted, the direction of ventilation returns to the initial one.

According to an additional possibility, the temperatures of the fan motors are measured and the power percentage of each motor will be subject to the highest temperature measured.

Making ventilation subject to the temperature of the motor may lead to a fixed operating speed (for example 30% of maximal speed for a motor temperature of 20° C., or 70% for a motor temperature of 45° C.) in order to limit the heat inputs in the cold room. These inputs present a risk of causing a cooling cycle to be restarted too quickly or of increasing the operating time of such a cycle. Preferably, as indicated, the power control percentage of the fan motors is unified and the level is aligned with the motor that has heated up the most.

In general, according to the invention, control includes management using control loops of the operation of the different components and of the parameters controlled, entailing alarms, if applicable, should the operation be analyzed as abnormal. In this regard, there is control of compliance with the reference limits set by the user.

In particular, operation allows an operational bias/fault to be identified/anticipated by comparison with an operational history. In other words, faults are analyzed with reference to an operational history aimed at automatic adjustment of parameterization to maintain the priority reference values (temperature/humidity). If applicable, the user is alerted and the system proposes remediation routines.

Thus, in the method according to the invention, to establish and use an operational history:

data, including durations, for the parameter processing cycles are measured and recorded over predetermined time periods, the steps of the setting the air flow through the enclosed space, selecting the number of cold batteries of the plurality of batteries to be in service, setting coolant temperature of the coolant flow, and setting circulation speed of the coolant flow, being recorded over predetermined time periods;

data for the parameter processing cycles set in motion are compared with the recorded data and durations; and if the differences exceed the predetermined values, corrective actions and alarms are triggered.

Operational data include in particular, but not exclusively, operating times for the cooling cycles, data on the ventilation cycles, on the operating cycles of the three-way valves, etc. These data are recorded for example over the past two months so as to be able to diagnose any system deviation or fault based on the history. Data that are not in accordance with the recorded history may be:

a cooling cycle that is too long or too frequent;

a blow temperature that is too low (burn risk for the stored foodstuffs);

a fall in the flow of air;

poor position of the three-way valve which no longer closes or does not open far enough;

deviation of one of the control sensors;

variation of the heat exchange coefficient;

other data may enter into consideration.

Depending on the fault identified and the automated putting in place of a diagnostic, corrective measures are taken automatically or, as mentioned earlier, an alarm is sounded. Thus, an abnormally long cooling cycle very probably indicates the appearance of frost on the cooler and leads to forced defrosting being initiated by the system, then to the cold production system being stopped, and 100% ventilation being initiated for a given period. Next, operations are restarted and measurements are taken over a period of days.

In this regard, according to one possibility, the coefficient of performance (COP) of the cooler may also be measured, recorded and compared with a predetermined COP value, a defrosting cycle for said cooler being initiated if the measured value is less than the predetermined value. This is because the appearance of frost systematically leads to a fall in COP.

Among other examples of parameter measurements that pose a problem may be cited a flow of air that rises for too long, which indicates that the cooler may be clogged. Or poor positioning of the three-way valve which no longer closes or does not open far enough making it impossible to stabilize the temperature—when stopped or in operation—requiring an alarm to be sounded. Or alternatively a deviation of one of the control sensors which leads to an anti-freeze security system alarm and automatic operational switching to another available sensor in the enclosed space.

Moreover, additional data may be used to adjust the regulation of the behavior of the stored products (adding different sensors, cascading loops allowing some parameters from said sensors to be adjusted, etc.).

The invention also relates to an enclosed refrigerated space for implementing the method described previously which delimits an internal volume comprising a cooler having a plurality of cold batteries provided with fins that define a heat exchange surface of the cooler, which as mentioned earlier has the following characteristics: the ratio between the heat exchange surface of the cooler and the internal volume of the enclosed refrigerated space ranges from 1.0 $m^2/m^3$ to 1.5 $m^2/m^3$, and the pitch of the fins positioned on the batteries of the cooler is between 2 mm and 5 mm.

BRIEF DESCRIPTION OF THE SEVERAL VIEWS OF THE DRAWINGS

Other objects and advantages of the present invention will appear on reading the following description which relates to embodiments of the invention that are given simply as indicative and non-limiting examples.

The description will be understood more easily by referring to the accompanying drawings.

DETAILED DESCRIPTION OF THE INVENTION

Figure 1:
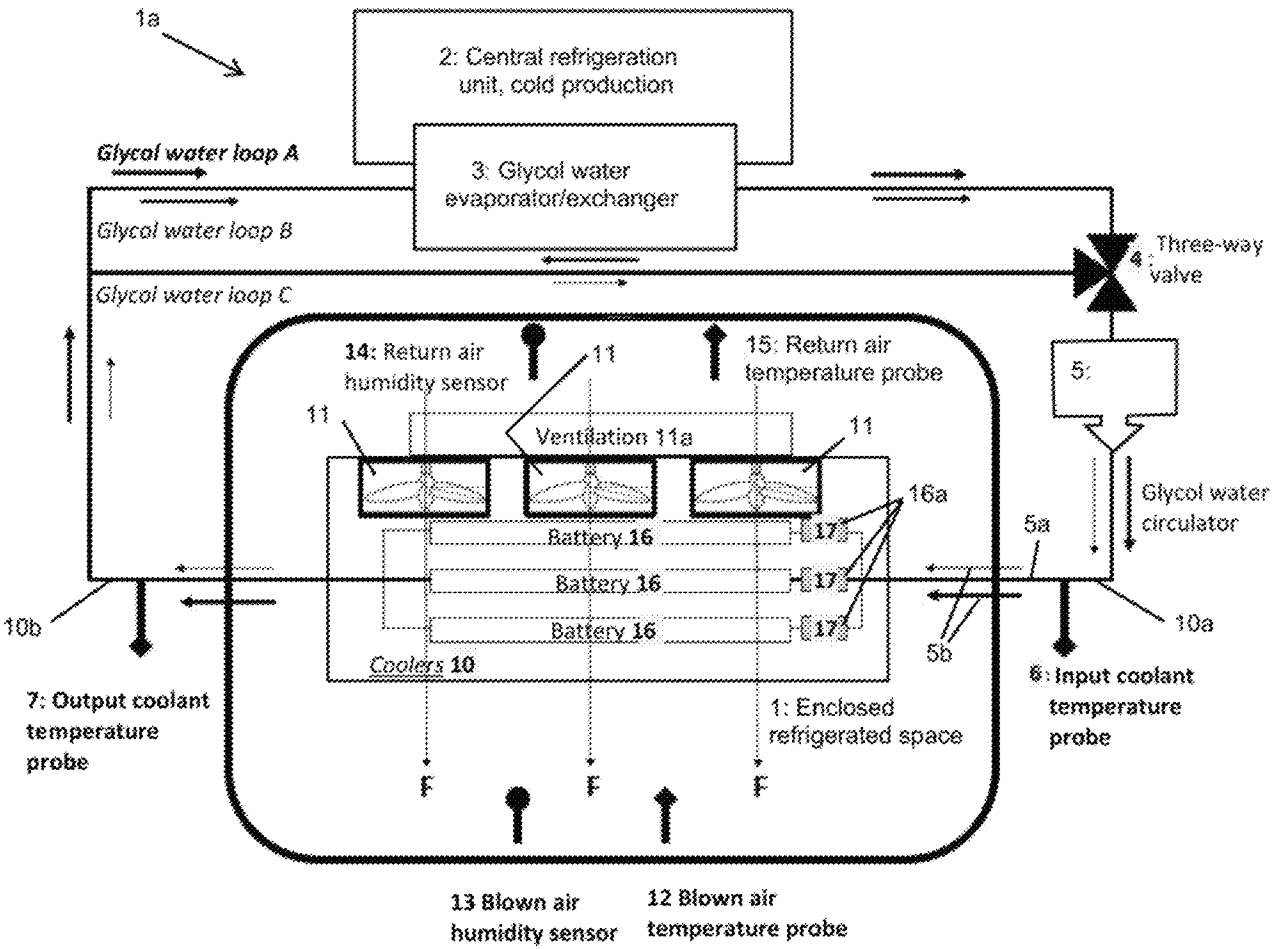
FIG. 1 is a diagrammatic schematic view of an enclosed refrigerated space according to the invention.

Cooling and humidification of the enclosed refrigerated space 1 of a system 1*a* are dependent on a number of components that appear in FIG. 1. Thus, a conventional central cooling unit 2 for producing cold comprising an evaporator/exchanger 3 allows the temperature of a coolant (for example glycol water) used to cool the enclosed space 1 to be controlled. The coolant circuit, outside the enclosed space 1 as such comprises—as well as the central cooling unit 2—a three-way valve 4 which manages a dual circulation loop between the inlet and the outlet of the enclosed space 1: a circulation branch (coolant flow passage 5*a*) for the coolant is thus redirected from the outlet straight to the inlet, and another branch passes through the evaporator/exchanger 3, their combined flows being managed by the three-way valve 4, which manages the relative flow of coolant from each loop, and more generally the flow of coolant (coolant flow 5*b*) entering the enclosed refrigerated space. A recirculation pump 5 or circulator 5 is positioned downstream of said valve 4, allowing the speed of the coolant to be controlled. Finally, coolant temperature sensors 6, 7 (coolant input temperature sensor 6, coolant output temperature sensor 7) are positioned at the inlet and the outlet respectively of a cooler 10 with a cooler input 10*a* and a cooler output 10*b* arranged inside the enclosed space 1.

Said cooler 10 is made up of a plurality of cold producing batteries 16 (cold batteries or heat exchangers) connected in parallel to the coolant circulation circuit, typically coolers through which the coolant flows controlled by solenoid valves 17 (means 16*a* for selecting a number of cold batteries to be in service) so that the cooling capacity can be adjusted by adding or removing one or more batteries 16. It should be noted that adjustment of the active exchange surface of the complete heat exchanger which is the cooler 10 can also be seen.

A plurality of fans 11 of a ventilation system 11*a*, the speed of which can be adjusted, varies the flow of air passing through the cooler. The arrows F indicate the direction of the air flows, showing the general direction conferred on the flow, which may however be reversed in some situations. These flows are directed transversally to the batteries 16, in order to provide correct cover of the exchange surface of the cooler 10 and, as a secondary matter, of the entire volume of the enclosed refrigerated space with regard to the overall mixing of the air, the properties of which are modified on contact with the exchange surfaces of the batteries 16. A temperature sensor 12 (downstream air temperature sensor 12) is positioned at the outlet (in the direction of the air flows indicated by the arrows F) of the cooler 10, in other words at the air blowing point. A humidity level sensor 13 (downstream humidity sensor 13) is positioned on the same side. A similar pair of temperature 15 and humidity 14 sensors (upstream air temperature sensor 15, upstream humidity sensor 14) is positioned at the inlet of the cooler 10, at the return air point.

The operation of all these components is managed by the automaton from initial reference values mainly for the humidity level and the air temperature. The values of the parameters controlled are adjusted simultaneously and constantly in order to maintain an atmosphere inside the enclosed refrigerated space 1 suitable for the conservation and preservation of various biological products that have a significant water composition, in particular free water, for example plant and animal foodstuffs, plants and trees, etc.

It is also useful to examine the incidence of variations of the different parameters, taken individually or considered successively, the other parameters being, if applicable, seen as dependent on the parameter in focus, or also considered individually below.

Concentrating first on control of the ventilation, and thus on control of the fans 11, the sensors that are first used to measure the effects of this control are the return air temperature sensor 15 (or the blown air temperature sensor 12, depending on the direction of ventilation or the choice of the user) and the return air humidity sensor 14. As emphasized repeatedly, the initial parameters remain temperature and humidity, and therefore the ventilation control is clearly observed in the light of the measurements for these parameters.

Thus, if the measured air temperature is higher than the reference temperature, a first comparison is made with a threshold temperature. If the measured temperature is above this threshold, this indicates a rise in temperature that is much too rapid, probably resulting in too long a period to allow the temperature to fall back within a suitable duration. In this case, the automaton adjusts upwards the air flow reference value for the internal fans 11 suitable for producing a flow of air through the cooler 10. The humidity measurement has no influence during this cycle which could be described as a "temperature priority" cycle, at least for a given time.

The humidity measurement plays a role if the measured temperature, although too high, is below said threshold. Three cases are then possible.

If the measured humidity of the air is less than the reference value, the automaton adjusts upwards the air flow reference value for the internal fans 11 producing a flow of air through the cooler 10 and consequently increases the measured humidity of the air. As the temperature of the coolant rises (see the examination of the other parameters below) and the ventilation accelerates, the water found on the exchange surface of the cooler 10 is released into the air by evaporation. Moreover, passing from the liquid state (water) to the gaseous state (water vapor) requires a thermal energy input: this energy is drawn from the ambient air, which results in a cooling of the air. In this process, the water molecules found on the surface of the water gradually change state to vapor, causing the measured humidity to rise and the temperature to fall. Moreover, the greater the flow of air, the better the water present in the ambient air is conserved, reducing condensation on the exchange surface of the cooler 10.

If the measured humidity of the air is equal to the reference value, the air flow reference value for the internal fans 11 is stabilized by the automaton in a neutral coolant air regulation zone.

Finally, if the measured humidity of the air is greater than the reference value, the air flow reference value for the internal fans 11 is reduced downwards, so as to reduce the flow of air through the cooler 10 with a view to reducing the measured humidity of the air. In this case, as the ventilation and coolant temperature reduce, the water present in the (moist) air is deposited on the exchange surface of the cooler 10 because the moist air passes over a colder surface, the temperature of which is below that of the dewpoint. The cooled air then loses some of its water vapor by condensation. As the flow of air is reduced, the contact time of the moist air with the cold surface increases, which encourages and further increases condensation.

Still concentrating on the control of the interior flow of air, this is addressed as follows if the air temperature inside the enclosed refrigerated space this time is at the reference temperature.

If the measured humidity of the air is also less than the reference value, the automaton adjusts the air flow reference value for the internal fans 11 upwards until said neutral regulation zone is stabilized in order to enrich the air by evaporation of the air trapped on the exchange surface of the cooler 10.

If the measured humidity of the air is greater than or equal to the reference value, the automaton reduces the ventilation reference value to the minimum in order to limit transmission of the heat released by the electric motors of the fans 11. However, the flow of air must be sufficient to capture the air temperature measurement very precisely and dynamically.

To accelerate detection of the rise in temperature of the interior air which results from the respiration heat of the products, the direction of ventilation is also reversed. Therefore, the air, being warmed up as a priority, is forced to return to the blow temperature sensor 12. If not, the cooling installation would need more time to capture the rise in temperature, as this would require the air to pass throughout the mass of stored products, and might even warm said products in passing, before returning to the blowing temperature sensor 12. Warming the products must be avoided as it produces temperature differences on the surface thereof, which are sources of conservation issues. As already mentioned, once the refrigeration cycle has been restarted, the direction of ventilation returns to the initial direction.

Regulation of the atmosphere inside the cold room may also be examined from the perspective of the control of the three-way valve 4, which controls in particular the temperature of the coolant. Returning to the distinctions made previously on the measured temperature and humidity, the following observations may be made.

Thus, if the measured temperature of the ambient air is higher than the reference temperature, control depends as indicated on a comparison with the above-mentioned threshold temperature. If the measured temperature is above this threshold, the automaton sends a signal to gradually open the three-way valve 4 to cause cold coolant to enter the cooler 10, leading to a lowering of the temperature of the coolant. For a given time, the priority is to reach the reference air temperature in the enclosed space. A maximal difference between the air temperature and the temperature of the coolant (DTmax)—parameterized according to the installation—is maintained with a view to reaching a minimal temperature measurement in the region of the blow sensor 12.

As already mentioned, the humidity is not measured at this stage as it has no influence during the "temperature priority" cycle. Only once the air temperature approaches the reference temperature does management return to measuring the humidity conditions. The same three cases are then managed by the automaton.

If the measured humidity of the air is less than the reference value, the automaton sends a signal to gradually close the three-way valve 4, allowing coolant to recirculate in the cooler 10, which causes the temperature thereof to rise. Consequently, the difference (DT) between the temperature of the air measured in the enclosed space 1 and that of the coolant reduces, which reduces condensation of the water present in the air and encourages evaporation of the water initially trapped on the exchange surface of the cooler 10, causing the measured humidity to increase.

If the measured humidity of the air is equal to the reference value, the automaton stabilizes the three-way valve 4 in a neutral "regulation" zone.

Finally, if the measured humidity of the air is greater than the reference value, the automaton sends a signal to gradually open the three-way valve 4 allowing colder coolant to enter into the cooler 10, producing there a fall in the temperature thereof, and thus allowing the difference between the air temperature and the coolant temperature to increase. This encourages condensation on the surface of the cooler 10, and eliminates the water present in the moist air, thus reducing the measured humidity.

Still concentrating on the control of the three-way valve 4, said control is different if the air temperature inside the enclosed refrigerated space 1 is less than or equal to the reference temperature. Thus, if the measured humidity of the air is less than or equal to the reference value, according to the method of the invention, the system closes the three-way valve 4.

However, if the measured humidity of the air is greater than the reference value, the automaton sends a signal to gradually open the three-way valve 4 until a fixed limit is reached, to cause a minimum amount of cold coolant to enter into the cooler 10, resulting in a fall in the temperature of said coolant in the enclosed space 1, and thus increasing the difference between the air temperature and the coolant temperature. This encourages condensation on the exchange surface of the cooler 10, and eliminates at least a fraction of the water present in the moist air, thus reducing the measured humidity. However, a limit is imposed on this operation to prevent the air temperature from falling too far.

Regulation of the atmosphere inside the cold room may then be examined from the perspective of the control of the flow of coolant, which it will be recalled is glycol water, for example. More precisely, the coolant input temperature sensor 6 is used to manage the operation of the circulator 5. Referring once again to the distinctions made previously in relation to the measured temperature and humidity, the following observations may be made.

Firstly, if the measured air temperature is higher than the reference temperature, a comparison is first made with the above-mentioned threshold temperature. If the measured temperature is above this threshold, the temperature priority cycle is set in motion, and the automaton gradually increases the speed of the circulator 5. This increase results in causing cold coolant to enter into the cooler 10, in which a lowering of the temperature of the coolant is produced. As soon as the measured air temperature in the enclosed space 1 approaches the reference temperature, overall control by the automaton goes back to managing the measured humidity.

If the measured humidity of the air is less than the reference value, the automaton reduces the reference speed of the circulator 5 to increase the temperature of the coolant in the cooler 10. Consequently, the difference (DT) between the temperature of the air measured in the enclosed space 1 and that of the coolant is reduced, which reduces condensation of the water present in the air and encourages evaporation of the water initially trapped on the exchange surface of the cooler 10. The measured humidity increases in proportion.

If the measured humidity of the air is equal to the reference value, the automaton stabilizes the circulator 5 in a neutral "regulation" zone.

Finally, if the measured humidity of the air is greater than the reference value, the automaton increases the speed of the circulator 5 in order to obtain a lowering of the temperature of the coolant in the cooler 10 and thus increase the difference between the temperature of the air in the enclosed space 1 and that of the coolant. This helps encourage condensation on the exchange surface of the cooler 10 and helps eliminate the water present in the moist air, thus reducing the measured humidity.

Still from the point of view of controlling the flow of coolant, management is different if the temperature of the air inside the enclosed refrigerated space 1 is less than or equal to the reference temperature.

If the measured humidity of the air is less than the reference value, the automaton controls the operation of the circulator 5 with a higher speed until a fixed limit is reached. However, the operating permission given by the automaton to the circulator only exists on condition that the temperature of the coolant is less than or equal to the temperature of the air measured in the enclosed space 1. The object is to encourage condensation on the exchange surface of the cooler 10, but without warming the ambient air.

If the measured humidity of the air is equal to the reference value, the circulator 5 is stopped by the automaton.

If the measured humidity of the air is greater than the reference value, the circulator 5 is commanded to operate up to a maximal programmed threshold, in conjunction with the three-way valve 4, to encourage light condensation on the exchange surface of the cooler 10, without the air temperature in the enclosed space 1 falling.

Finally, regulation of the atmosphere inside the cold room may be examined from the point of view of cooling capacity or active exchange surface, in other words, by managing a plurality of cold batteries 16 in service. The distinctions made previously in relation to the measured temperature and humidity are referred to again below.

First, if a temperature priority cycle is in progress without the humidity being measured, the automaton opens 100% of the solenoid valves 17 that open the flow of coolant, to cause cold coolant to enter all the batteries 16 of the cooler 10 (see FIG. 1), leading to a lowering of the temperature of the coolant initially present in the batteries 16. This priority cycle, which aims to reach the reference temperature as quickly as possible, is applied for a limited period before the automaton reverts to the operation that is the subject of the following paragraphs, resuming the humidity measurements when the temperature of the ambient air approaches the reference temperature.

In this case, where a temperature priority cycle is implemented, if the measured humidity of the air is less than the reference value, the automaton opens all the solenoid valves 17 that open the flow of coolant to cause coolant to enter the batteries 16 of the cooler 10 in order to use 100% of the exchange surface thereof to increase the temperature of the coolant in the cooler 10. Consequently, the difference (DT) between the temperature of the air in the enclosed space 1 and that of the coolant is reduced, which reduces condensation of the water present in the air and encourages evaporation of the water initially trapped on the exchange surface of the cooler 10, which ultimately increases the measured humidity.

If the measured humidity of the air is equal to the reference value, the automaton stabilizes the percentage of open solenoid valves 17 and therefore the percentage of the batteries 16 in operation, in other words, conveying the coolant.

Finally, if the measured humidity of the air is greater than the reference value, the automaton gradually closes the solenoid valves 17 that open the flow of coolant, so as to use a smaller exchange surface to cause coolant with a lowered temperature to enter only the last battery of the cooler 10 in order to obtain a lowering of the temperature of internal coolant and thus increase the difference between the temperature of the air and that of the coolant. This encourages condensation on said cold battery and eliminates the water present in the moist air, thus reducing the measured humidity while gradually lowering the cooling capacity of the cooler 10.

Figure 2:
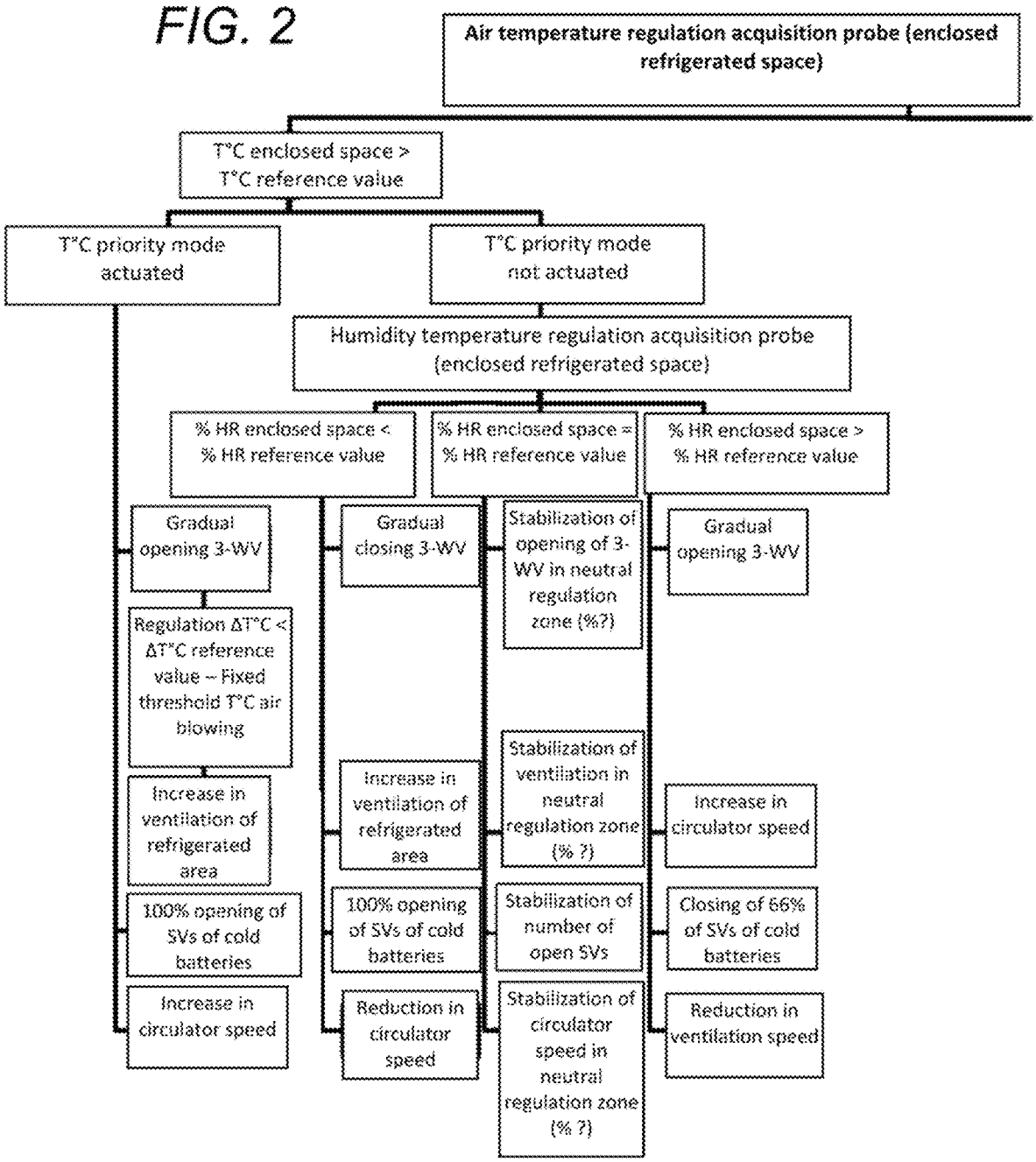
FIG. 2 is a schematic view of the first part of an operating flowchart that shows the control system for the enclosed refrigerated space in the previous figure, in the case where the temperature measured in the enclosed space is higher than the reference temperature.
Figure 3:
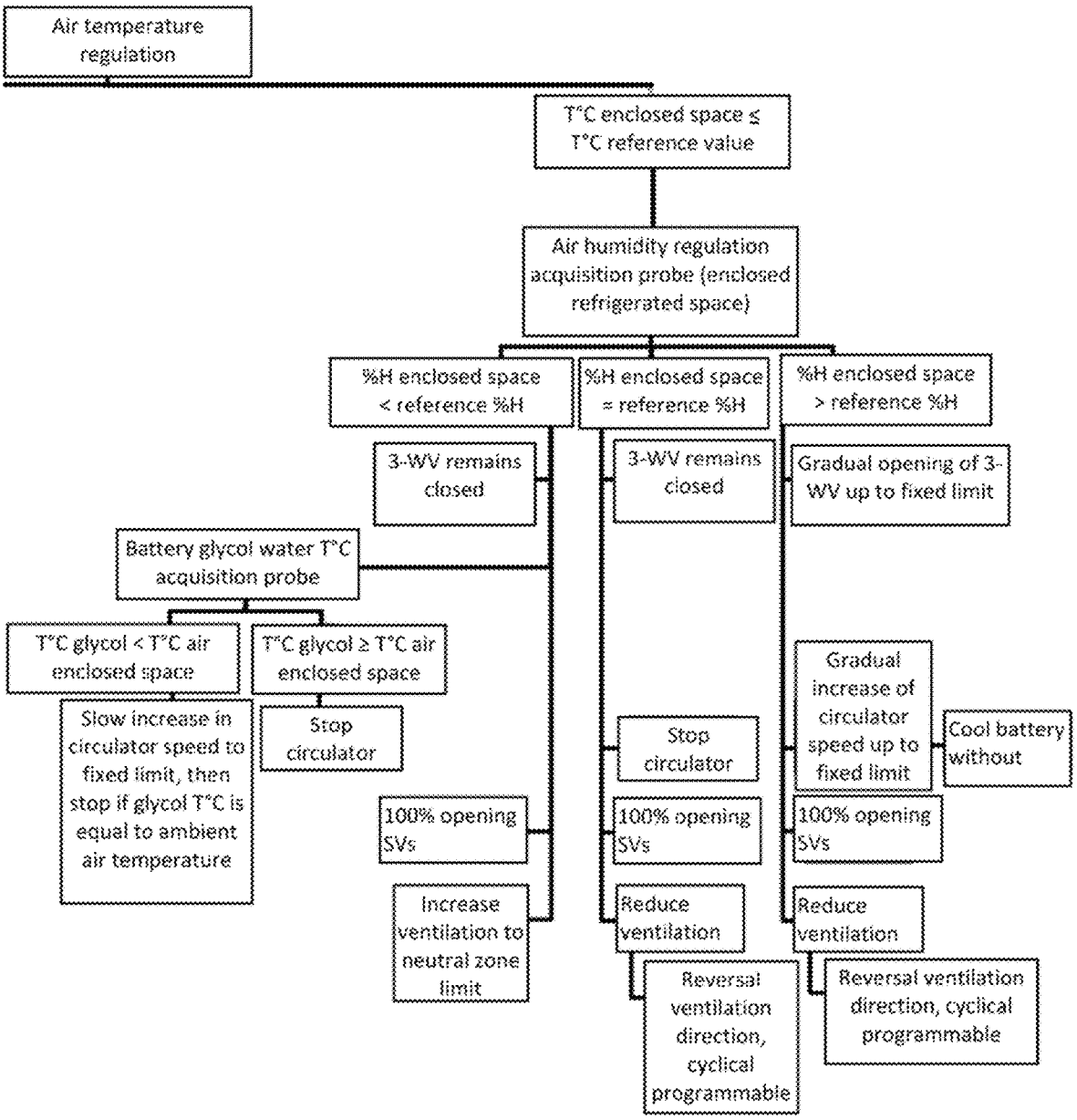
FIG. 3 is a schematic view of the second part of the operating flowchart that shows the control system for the enclosed refrigerated space in FIG. 1, in the case where the temperature measured in the enclosed space is less than or equal to the reference temperature.

FIGS. 2 and 3 synthesize the management of the different parameters that allow accurate control of the atmosphere of the enclosed refrigerated space 1 of FIG. 1. The flowchart clearly shows the preeminence in said control of the temperature and humidity level parameters, and of the tests initially carried out by the automaton on these parameters. As the enclosed space 1 is a cold room, temperature is of course the master parameter for all the management, followed by measurements and tests on the humidity of said enclosed space 1.

Next come the other parameters or the devices said parameters manage, which can be seen in each branch of the flowchart and are the three-way valve 4, the circulator 5, the cold batteries 16 of the cooler 10 and the fans 11. As seen in detail previously, each device has an impact on at least one parameter.

In FIG. 2, which shows the control if the temperature measured in the enclosed space 1 is higher than the reference temperature, in other words if refrigeration is not sufficient, the two hypotheses can be clearly distinguished depending on whether or not the temperature exceeds a predetermined threshold. If the threshold is exceeded, meaning that there is an urgent need to take action, priority—or even exclusivity—is given to the processing of the temperature without taking the measured humidity into consideration. It is the farthest left branch in FIG. 2 that is concerned, this case being designated "Priority mode T° C. activated."

In this branch, as stated between the two blocks relating to the three-way valve 4 and the circulator 5, regulation is carried out based firstly on a maximal difference reference value between the temperature of the air and that of the coolant, parameterized according to the installation, and secondly on a minimum reference temperature measured by the blow sensor 12 (or by the return sensor 15) and controlled by said maximal programmed difference.

The other three branches cause the intervention of the measurement of the humidity level, and compare said measurement with the initial measured humidity reference value.

The same applies to the branches of FIG. 3, which relate to the case where the temperature measured in the enclosed space 1 is less than or equal to the reference temperature. Taking account of the level of measured humidity therefore intervenes in all the hypotheses and consequently generates the three branches that can be seen in this figure.

In the branch on the left of FIG. 3, the measured humidity of the air is less than the reference value and a measurement is taken of the temperature of the coolant by the sensor 6. If said temperature is less than the temperature measured in the enclosed space 1, the speed of the circulator 5 is increased until a fixed limit is reached. In the reverse hypothesis, the circulator 5 is stopped. The object is to encourage vaporization of water present on the exchange surface of the cooler 10, but without warming the ambient air.

In the other two branches, it should be noted that the direction of the ventilation is reversed for reasons that take account of the need to speed up measurement of the warming of the ambient air without said air being constrained to pass through the entire mass of the stored products.

It should be noted that in the branch farthest to the right, the circulator 5 is controlled to operate to a maximum threshold of its maximal flow in conjunction with the three-way valve 4 to encourage light condensation on the cooler 10, without the temperature of the ambient air falling.

The operating examples above, in conjunction with the figures, are not exhaustive examples of the invention, which on the contrary encompasses variations, notably of structure (number of sensors, cold batteries, etc.).

We claim:

1. A method of operating a system having an enclosed space being comprised of a cooler with a cooler input and a cooler output opposite said cooler input, said method comprising the steps of:

setting air flow through said enclosed space, wherein said cooler comprises:

a plurality of cold batteries;

means for selecting a number of cold batteries from said plurality of cold batteries to be in service;

a coolant flow passage connected to a coolant flow; and a ventilation system being comprised of a plurality of fans, wherein said enclosed space is further comprised of:

a coolant input temperature sensor at said cooler input;

a coolant output temperature sensor at said cooler output;

an upstream air temperature sensor upstream from a fan of said plurality of fans;

a downstream air temperature sensor downstream from said fan of said plurality of fans;

an upstream humidity sensor upstream from said fan of said plurality of fans; and a downstream humidity sensor downstream from said fan of said plurality of fans, wherein the step of setting air flow comprises at least one of the following steps:

increasing air flow when a measured air temperature within said enclosed space is greater than a reference air temperature and greater than a threshold air temperature;

increasing air flow when said measured air temperature is greater than said reference air temperature and less than said threshold air temperature and when a measured humidity level within said enclosed space is less than a reference humidity level;

reducing air flow when said measured air temperature is greater than said reference air temperature and less than said threshold air temperature and when said measured humidity level is greater than said reference humidity level; and stabilizing air flow when said measured air temperature is greater than said reference air temperature and less than said threshold air temperature and when said measured humidity level is equal to said reference humidity level;

selecting a number of cold batteries of said plurality of batteries to be in service so as to establish cooling capacity, wherein the step of selecting said number of cold batteries comprises at least one of the following steps:

selecting all cold batteries of said plurality of cold batteries to be said number of cold batteries of said plurality of batteries in service when said measured air temperature is greater than said reference air temperature and greater than said threshold air temperature as a maximum cooling capacity;

selecting all cold batteries of said plurality of cold batteries to be said number of cold batteries of said plurality of batteries in service when said measured air temperature is greater than said reference air temperature and less than said threshold air temperature and when said measured humidity level is less than said reference humidity level;

selecting a third of said plurality of cold batteries to be said number of cold batteries of said plurality of batteries in service when said measured air temperature is greater than said reference air temperature and less than said threshold air temperature and when said measured humidity level is greater than said reference humidity level; and stabilizing said number of cold batteries of said plurality of batteries in service when said measured air temperature is greater than said reference air temperature and less than said threshold air temperature and when said measured humidity level is equal to said reference humidity level;

setting coolant temperature of said coolant flow, wherein the step of setting said coolant temperature of said coolant flow comprises at least one of the following steps:

increasing said coolant temperature of said coolant flow when said measured air temperature is greater than said reference air temperature and greater than said threshold air temperature;

increasing said coolant temperature of said coolant flow when said measured air temperature is greater than said reference air temperature and less than said threshold air temperature and when said measured humidity level is less than said reference humidity level;

reducing said coolant temperature of said coolant flow when said measured air temperature is greater than said reference air temperature and less than said threshold air temperature and when said measured humidity level is greater than said reference humidity level; and stabilizing said coolant temperature of said coolant flow when said measured air temperature is greater than said reference air temperature and less than said threshold air temperature and when said measured humidity level is equal to said reference humidity level;

setting circulation speed of said coolant flow, wherein the step of setting circulation speed of said coolant flow comprises at least one of the following steps:

increasing said circulation speed of said coolant flow when said measured air temperature is greater than said reference air temperature and greater than said threshold air temperature;

increasing said circulation speed of said coolant flow when said measured air temperature is greater than said reference air temperature and less than said threshold air temperature and when said measured humidity level is less than said reference humidity level;

increasing said circulation speed of said coolant flow when said measured air temperature is greater than said reference air temperature and less than said threshold air temperature and when said measured humidity level is greater than said reference humidity level; and stabilizing said circulation speed of said coolant flow when said measured air temperature is greater than said air reference temperature and less than said air threshold temperature and when said measured humidity level is equal to said reference humidity level.

2. The method for operating the system having the enclosed space being comprised of the cooler, according to claim 1, wherein said system further comprises:

a central refrigeration unit;

a glycol water evaporator/exchanger in communication with said central refrigeration unit; and a three way valve connected to said glycol water evaporator/exchanger; and a glycol water circulator connected to said three way valve so as to provide said coolant flow of said cooler.

3. The method for operating the system having the enclosed space being comprised of the cooler, according to claim 1, where said threshold air temperature is within three degrees Celsius of said reference air temperature.

4. The method for operating the system having the enclosed space being comprised of the cooler, according to claim 1, wherein said ventilation system is further comprised of a plurality of motors, wherein each fan of said plurality of fans has a corresponding motor of said plurality of motors, wherein each motor of said plurality of motors has a motor temperature and a power percentage, and wherein said motor temperature and said power percentage is determined by a highest measured air temperature.

5. The method for operating the system having the enclosed space being comprised of the cooler, according to claim 1, further comprising the steps of:

recording data of the steps of the setting said air flow through said enclosed space, selecting said number of cold batteries of said plurality of batteries to be in service, setting coolant temperature of said coolant flow, and setting circulation speed of said coolant flow, over predetermined time periods, said data including duration of each step;

comparing said data so as to determine differences; and triggering corrective actions and alarms, when said differences exceed predetermined alarm values.

6. The method for operating the system having the enclosed space being comprised of the cooler, according to claim 1, wherein said cooler has a coefficient of performance (COP), the method further comprising the step of:

initiating a defrosting cycle of said cooler when a measured COP is less than a predetermined COP value.

7. The method for operating the system having the enclosed space being comprised of the cooler, according to claim 1, wherein each cold battery of said plurality of cold batteries is comprised of a fin so as to define a heat exchange surface of said cooler, wherein a ratio between said heat exchange surface and an internal volume of said enclosed space ranges from 1.0 m2/m3 to 1.5 m2/m3, and wherein a pitch of said fin is between 2 mm and 5 mm.

8. A method of operating a system having an enclosed space being comprised of a cooler with a cooler input and a cooler output opposite said cooler input, said method comprising the steps of:

setting air flow through said enclosed space, wherein said cooler comprises:

a plurality of cold batteries;

means for selecting a number of cold batteries from said plurality of cold batteries to be in service;

a coolant flow passage connected to a coolant flow; and a ventilation system being comprised of a plurality of fans, wherein said enclosed space is further comprised of:

a coolant input temperature sensor at said cooler input;

a coolant output temperature sensor at said cooler output;

an upstream air temperature sensor upstream from a fan of said plurality of fans;

a downstream air temperature sensor downstream from said fan of said plurality of fans;

an upstream humidity sensor upstream from said fan of said plurality of fans; and a downstream humidity sensor downstream from said fan of said plurality of fans, wherein the step of setting air flow comprises at least one of the following steps:

increasing air flow when a measured air temperature within said enclosed space is greater than a reference air temperature and greater than a threshold air temperature;

increasing air flow when said measured air temperature is greater than said reference air temperature and less than said threshold air temperature and when a measured humidity level is less than a reference humidity level;

reducing air flow when said measured air temperature is greater than said reference air temperature and less than said threshold air temperature and when said measured humidity level is greater than said reference humidity level;

stabilizing air flow when said measured air temperature is greater than said reference air temperature and less than said threshold air temperature and when said measured humidity level is equal to said reference humidity level;

increasing air flow when said measured air temperature is less than said reference air temperature and when said measured humidity level is less than said reference humidity level;

increasing air flow when said measured air temperature is equal to said reference air temperature and when said measured humidity level is less than said reference humidity level;

reducing air flow to a predetermined value when said measured air temperature is less than said reference air temperature and when said measured humidity level is equal to said reference humidity level;

reducing air flow to said predetermined value when said measured air temperature is equal to said reference air temperature and when said measured humidity level is equal to said reference humidity level;

reversing air flow when said measured air temperature is less than said reference air temperature and when said measured humidity level is equal to said reference humidity level;

reversing air flow when said measured air temperature is equal to said reference air temperature and when said measured humidity level is equal to said reference humidity level;

reducing air flow to said predetermined value when said measured air temperature is less than said reference air temperature and when said measured humidity level is greater than said reference humidity level; and reversing air flow when said measured air temperature is less than said reference air temperature and when said measured humidity level is greater than said reference humidity level;

selecting a number of cold batteries of said plurality of batteries to be in service so as to establish cooling capacity, wherein the step of selecting said number of cold batteries comprises at least one of the following steps:

selecting all cold batteries of said plurality of cold batteries to be said number of cold batteries of said plurality of batteries in service when said measured air temperature is greater than said reference air temperature and greater than said threshold air temperature as a maximum cooling capacity;

selecting all cold batteries of said plurality of cold batteries to be said number of cold batteries of said plurality of batteries in service when said measured air temperature is greater than said reference air temperature and less than said threshold air temperature and when said measured humidity level is less than said reference humidity level;

selecting a third of said plurality of cold batteries to be said number of cold batteries of said plurality of batteries in service when said measured air temperature is greater than said reference air temperature and less than said threshold air temperature and when said measured humidity level is greater than said reference humidity level;

stabilizing said number of cold batteries of said plurality of batteries in service when said measured air temperature is greater than said reference air temperature and less than said threshold air temperature and when said measured humidity level is equal to said reference humidity level;

selecting all cold batteries of said plurality of cold batteries to be said number of cold batteries of said plurality of batteries in service when said measured air temperature is less than said reference air temperature and when said measured humidity level is less than said reference humidity level;

selecting all cold batteries of said plurality of cold batteries to be said number of cold batteries of said plurality of batteries in service when said measured air temperature is equal to said reference air temperature and when said measured humidity level is less than said reference humidity level;

selecting all cold batteries of said plurality of cold batteries to be said number of cold batteries of said plurality of batteries in service when said measured air temperature is less than said reference air temperature and when said measured humidity level is equal to said reference humidity level;

selecting all cold batteries of said plurality of cold batteries to be said number of cold batteries of said plurality of batteries in service when said measured air temperature is equal to said reference air temperature and when said measured humidity level is equal to said reference humidity level;

selecting all cold batteries of said plurality of cold batteries to be said number of cold batteries of said plurality of batteries in service when said measured air temperature is less than said reference air temperature and when said measured humidity level is greater than said reference humidity level; and selecting all cold batteries of said plurality of cold batteries to be said number of cold batteries of said plurality of batteries in service when said measured air temperature is less than said reference air temperature and when said measured humidity level is greater than said reference humidity level;

setting coolant temperature of said coolant flow, wherein the step of setting said coolant temperature of said coolant flow comprises at least one of the following steps:

increasing said coolant temperature of said coolant flow when said measured air temperature is greater than said reference air temperature and greater than said threshold air temperature;

increasing said coolant temperature of said coolant flow when said measured air temperature is greater than said reference air temperature and less than said threshold air temperature and when said measured humidity level is less than said reference humidity level;

reducing said coolant temperature of said coolant flow when said measured air temperature is greater than said reference air temperature and less than said threshold air temperature and when said measured humidity level is greater than said reference humidity level;

stabilizing said coolant temperature of said coolant flow when said measured air temperature is greater than said reference air temperature and less than said threshold air temperature and when said measured humidity level is equal to said reference humidity level;

stabilizing said coolant temperature of said coolant flow when said measured air temperature is less than said reference air temperature and when said measured humidity level is equal to said reference humidity level;

stabilizing said coolant temperature of said coolant flow when said measured air temperature is equal to said reference air temperature and when said measured humidity level is equal to said reference humidity level;

reducing said coolant temperature of said coolant flow to a predetermined coolant temperature value when said measured air temperature is less than said reference air temperature and when said measured humidity level is greater than said reference humidity level; and reducing said coolant temperature of said coolant flow to said predetermined coolant temperature when said measured air temperature is less than said reference air temperature and when said measured humidity level is equal to said reference humidity level;

reducing said coolant temperature of said coolant flow to a predetermined coolant temperature value when said measured air temperature is equal to said reference air temperature and when said measured humidity level is greater than said reference humidity level; and reducing said coolant temperature of said coolant flow to said predetermined coolant temperature when said measured air temperature is equal to said reference air temperature and when said measured humidity level is equal to said reference humidity level; and setting circulation speed of said coolant flow, wherein the step of setting circulation speed of said coolant flow comprises at least one of the following steps:

increasing said circulation speed of said coolant flow when said measured air temperature is greater than said reference air temperature and greater than said threshold air temperature;

increasing said circulation speed of said coolant flow when said measured air temperature is greater than said reference air temperature and less than said threshold air temperature and when said measured humidity level is less than said reference humidity level;

increasing said circulation speed of said coolant flow when said measured air temperature is greater than said reference air temperature and less than said threshold air temperature and when said measured humidity level is greater than said reference humidity level;

stabilizing said circulation speed of said coolant flow when said measured air temperature is greater than said air reference temperature and less than said air threshold temperature and when said measured humidity level is equal to said reference humidity level;

increasing said circulation speed of said coolant flow when said measured air temperature is less than said reference air temperature, when said measured humidity level is less than said reference humidity level, and when said coolant temperature is less than said measured air temperature;

increasing said circulation speed of said coolant flow when said measured air temperature is equal to said reference air temperature, when said measured humidity level is less than said reference humidity level and when said coolant temperature is less than said measured air temperature;

reducing said circulation speed of said coolant flow to zero when said measured air temperature is less than said reference air temperature, when said measured humidity level is less than said reference humidity level, and when said coolant temperature is greater than said measured air temperature;

reducing said circulation speed of said coolant flow to zero when said measured air temperature is equal to said reference air temperature, when said measured humidity level is less than said reference humidity level and when said coolant temperature is greater than said measured air temperature;

reducing said circulation speed of said coolant flow to zero when said measured air temperature is less than said reference air temperature, when said measured humidity level is less than said reference humidity level, and when said coolant temperature is equal to said measured air temperature;

reducing said circulation speed of said coolant flow to zero when said measured air temperature is equal to said reference air temperature, when said measured humidity level is less than said reference humidity level and when said coolant temperature is equal to said measured air temperature;

reducing said circulation speed of said coolant flow to zero when said measured air temperature is less than said reference air temperature and when said measured humidity level is equal to said reference humidity level;

reducing said circulation speed of said coolant flow to zero when said measured air temperature is equal to said reference air temperature and when said measured humidity level is equal to said reference humidity level;

increasing said circulation speed of said coolant flow to a predetermined higher value when said measured air temperature is less than said reference air temperature and when said measured humidity level is greater than said reference humidity level;

increasing said circulation speed of said coolant flow to said predetermined higher value when said measured air temperature is equal to said reference air temperature and when said measured humidity level is greater than said reference humidity level;

increasing said circulation speed of said coolant flow to said predetermined higher value when said measured air temperature is less than said reference air temperature and when said measured humidity level is equal to said reference humidity level; and increasing said circulation speed of said coolant flow to said predetermined higher value when said measured air temperature is equal to said reference air temperature and when said measured humidity level is equal to said reference humidity level.

* * * * *